US010680363B2

(12) United States Patent
Phillips et al.

(10) Patent No.: US 10,680,363 B2
(45) Date of Patent: Jun. 9, 2020

(54) CARD EDGE CONNECTOR ASSEMBLY

(71) Applicant: TE CONNECTIVITY CORPORATION, Berwyn, PA (US)

(72) Inventors: Michael John Phillips, Camp Hill, PA (US); Randall Robert Henry, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/994,314

(22) Filed: May 31, 2018

(65) Prior Publication Data

US 2019/0372256 A1 Dec. 5, 2019

(51) Int. Cl.

| | |
|---|---|
| ***H01R 12/72*** | (2011.01) |
| ***H01R 12/70*** | (2011.01) |
| ***H01R 12/52*** | (2011.01) |
| ***H01R 13/627*** | (2006.01) |

(Continued)

(52) U.S. Cl.

CPC ..... *H01R 12/721* (2013.01); *H01R 12/52* (2013.01); *H01R 12/7005* (2013.01); *H01R 12/7076* (2013.01); *H01R 24/60* (2013.01); *H01R 13/6271* (2013.01); *H01R 2107/00* (2013.01)

(58) Field of Classification Search

CPC ..... H01R 13/6275; H01R 12/716; H01R 12/727; H01R 13/629; H01R 12/7005; H01R 12/7047; H01R 12/71; H01R 12/722; H01R 12/724; H01R 12/732; H01R 13/6273; H01R 13/631; H01R 13/6471; H01R 13/6581; H01R 13/6582; H01R 2107/00; H01R 24/60; H01R 27/02; H01R 12/515; H01R 12/52; H01R 12/592; H01R 12/62; H01R 12/7011; H01R 12/7052; H01R 12/7058; H01R 12/707; H01R 12/7076; H01R 12/737; H01R 12/79; H01R 13/512; H01R 13/6272; H01R 13/6335; H01R 13/639; H01R 13/64; H01R 13/641; H01R 13/642; H01R 13/6473; H01R 13/6594; H01R 24/28; H01R 24/58; H01R 24/62

See application file for complete search history.

(56) References Cited

U.S. PATENT DOCUMENTS 5,816,842 A * 10/1998 Thantrakul ..... G11B 33/122 439/374
6,071,141 A * 6/2000 Semmeling ..... H01R 13/6275 439/353

(Continued)

*Primary Examiner* — James Harvey
*Assistant Examiner* — Matthew T Dzierzynski

(57) ABSTRACT

A card edge connector assembly includes a card edge connector having a housing defining a card slot and holding contacts to electrically connect to a pluggable module and a host circuit board. The card edge connector assembly includes a guide cover having a main body including a first side wall between first and second end walls. The main body defines a center cavity receiving the housing and the pluggable module. The guide cover has a first alignment channel between the center cavity and the first end wall and a second alignment channel between the center cavity and the second end wall. The alignment channels are configured to receive alignment posts of the pluggable module prior to the card slot receiving the pluggable module.

20 Claims, 5 Drawing Sheets

(51) Int. Cl.
*H01R 24/60* (2011.01)
*H01R 107/00* (2006.01)

(56) References Cited

U.S. PATENT DOCUMENTS 6,976,876 B1 * 12/2005 Su ..... H01R 13/6583 439/357
7,083,460 B2 * 8/2006 Wu ..... H01R 13/6275 439/357
7,192,297 B1 * 3/2007 Wu ..... H01R 12/592 439/358
7,413,461 B2 * 8/2008 Dawiedczyk ..... H01R 13/6275 439/357
7,448,897 B2 * 11/2008 Dawiedczyk ..... H01R 13/6275 439/357
7,946,887 B1 * 5/2011 Zhang ..... H01R 27/02 439/607.23
7,963,800 B1 * 6/2011 Chen ..... H01R 12/7047 439/607.27
7,993,161 B2 * 8/2011 Mao ..... H01R 12/7052 439/607.4
8,137,131 B2 * 3/2012 Wang ..... H01R 12/725 439/570
8,215,995 B1 * 7/2012 Little ..... H01R 12/7052 439/638
9,281,623 B2 * 3/2016 Yuan ..... H01R 13/6471
9,300,065 B2 * 3/2016 Yuan ..... H01R 12/732
9,331,432 B1 5/2016 Phillips
9,391,396 B1 * 7/2016 Yi ..... H01R 13/6273
9,397,442 B2 7/2016 Sutter et al.
9,728,871 B1 * 8/2017 Gutgold ..... H01R 12/515
9,768,560 B2 * 9/2017 Yao ..... H01R 13/6594
9,865,974 B2 * 1/2018 Chen ..... H01R 24/62
10,141,697 B2 * 11/2018 Wang ..... H01R 24/60
10,177,476 B1 1/2019 Phillips et al.
10,218,097 B2 2/2019 Phillips et al.
10,276,976 B1 4/2019 Phillips et al.
10,320,100 B2 6/2019 Phillips
2008/0176455 A1 * 7/2008 Fang ..... H01R 12/716 439/709
2012/0077365 A1 * 3/2012 Kobayashi ..... H01R 13/4223 439/345
2012/0077389 A1 * 3/2012 Zhang ..... H01R 24/60 439/660
2015/0056858 A1 * 2/2015 Guo ..... H01R 12/722 439/607.35
2018/0205177 A1 * 7/2018 Zhou ..... H01R 13/631
2018/0254571 A1 * 9/2018 Herring ..... H01R 12/721
2018/0301833 A1 10/2018 Herring et al.
2019/0058270 A1 2/2019 Henry et al.
2019/0181574 A1 6/2019 Herring

* cited by examiner

CARD EDGE CONNECTOR ASSEMBLY

BACKGROUND OF THE INVENTION

The subject matter herein relates generally to card edge connector assemblies.

Card edge connectors are used in various system applications. For example, card edge connectors are typically mounted to a host circuit board. The card edge connectors include card slots for receiving a card edge, such as a circuit card of a pluggable module. However, known card edge connectors are not without disadvantages. For instance, the card edge connectors are typically designed for supporting the pluggable modules. The card edge connectors are subjected to stresses and strains during mating or when mated with the pluggable modules, which may damage or break soldered connections between the contacts of the card edge connector and the host circuit board. Additionally, the card edge connectors are susceptible to damage during to incorrectly loading or unloading of the pluggable module when mating and unmating. For example, if the edge of the circuit card is loading into the card slot at an angle, the contacts may be damaged. Additionally, correction of the mis-alignment of the circuit card in the card slot can lead to further damage of the contacts.

A need remains for a card edge connector assembly that may be mated with pluggable modules in a reliable manner.

BRIEF DESCRIPTION OF THE INVENTION

In one embodiment, a card edge connector assembly is provided including a card edge connector having a housing defining a card slot configured to receive a pluggable module in a mating direction. The housing holds contacts in the card slot to electrically connect to the pluggable module and electrically connect to a host circuit board. The card edge connector assembly includes a guide cover having a main body including a first end wall, a second end wall opposite the first end wall, and a first side wall between the first and second end walls. The main body defines a center cavity receiving the housing of the card edge connector and configured to receive the pluggable module. The guide cover has a first alignment channel between the center cavity and the first end wall and a second alignment channel between the center cavity and the second end wall. The first and second alignment channels are configured to receive alignment posts of the pluggable module prior to the card slot receiving the pluggable module.

In another embodiment, a card edge connector assembly is provided including a card edge connector having a housing defining a card slot configured to receive a pluggable module in a mating direction. The housing holds contacts in the card slot to electrically connect to the pluggable module and electrically connect to a host circuit board. The card edge connector assembly includes a guide frame coupled to the housing extending forward of the housing. The guide frame has a guide track extending parallel to the mating direction receiving a guide rib of the pluggable module to guide mating of the pluggable module into the card slot. The card edge connector assembly includes a guide cover having a main body including a first end wall, a second end wall opposite the first end wall, and a first side wall between the first and second end walls. The main body defines a center cavity receiving the housing of the card edge connector and the guide frame and configured to receive the pluggable module. The guide cover has a first alignment channel between the center cavity and the first end wall and a second alignment channel between the center cavity and the second end wall. The first and second alignment channels are configured to receive alignment posts of the pluggable module prior to the guide track of the guide frame receiving the guide rib.

In a further embodiment, a card edge connector assembly is provided including a card edge connector having a housing and a guide cover at least partially surrounding the housing. The housing defines a card slot and holds contacts in the card slot. The contacts are configured to be electrically connected to a host circuit board. The guide cover has a main body including a first end wall, a second end wall opposite the first end wall, and a first side wall between the first and second end walls. The main body defines a center cavity receiving the housing of the card edge connector. The guide cover has a first alignment channel between the center cavity and the first end wall and a second alignment channel between the center cavity and the second end wall. The card edge connector assembly includes a pluggable module mated with the card edge connector. The pluggable module has a plug card having plug contacts arranged at a card edge of the plug card. The pluggable module has a plug body including a hub holding the plug card. The plug body has a first alignment post outboard of a first end of the hub and a second alignment post outboard of a second end of the hub. The first and second alignment posts extend forward of the hub. The first and second alignment channels receive the first and second alignment posts, respectively, prior to the card slot receiving the card edge of the circuit card of the pluggable module.

DETAILED DESCRIPTION OF THE INVENTION

Figure 1:
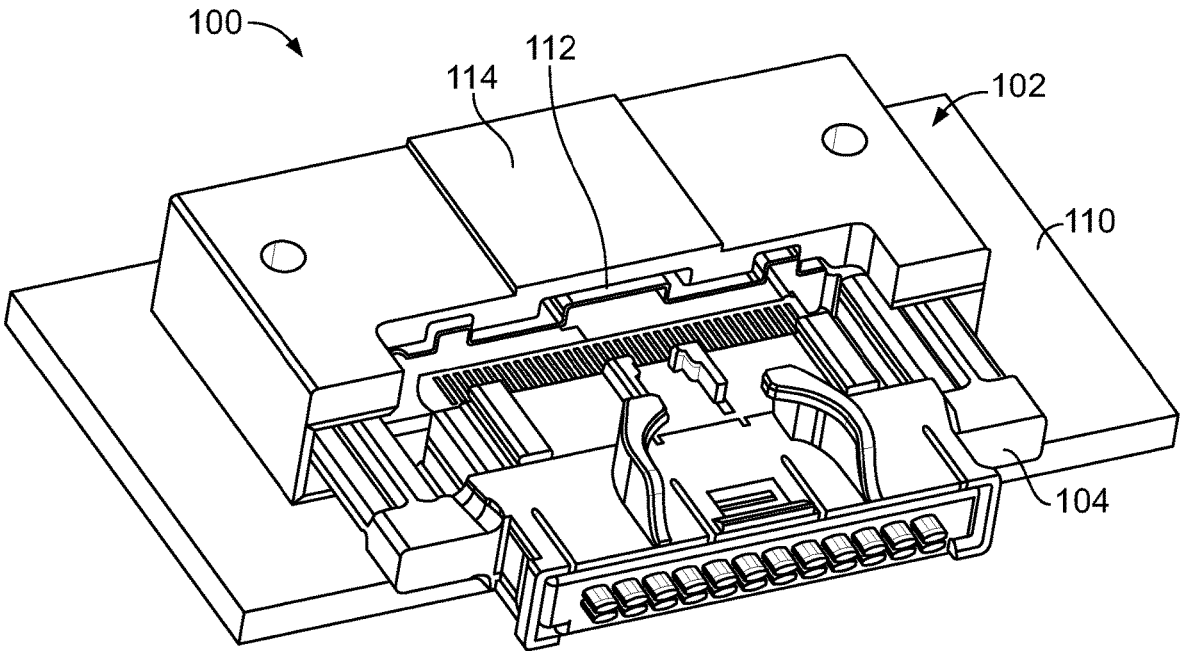
FIG. 1 is a perspective view of an electrical system having a card edge connector assembly in accordance with an exemplary embodiment.
Figure 2:
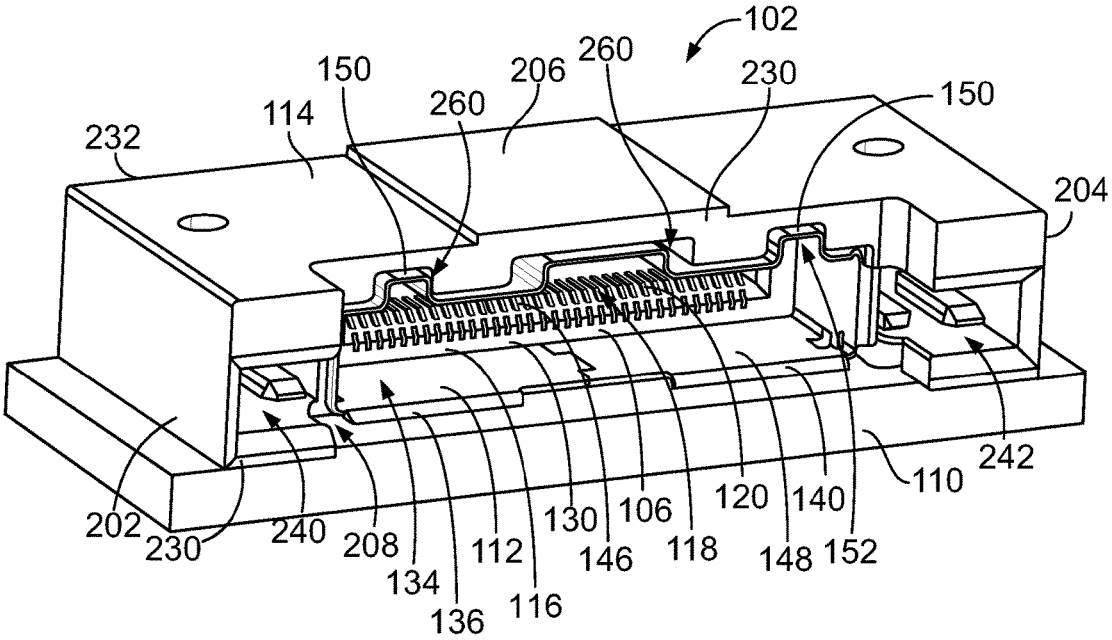
FIG. 2 is a front perspective view of the card edge connector assembly in accordance with an exemplary embodiment.
Figure 3:
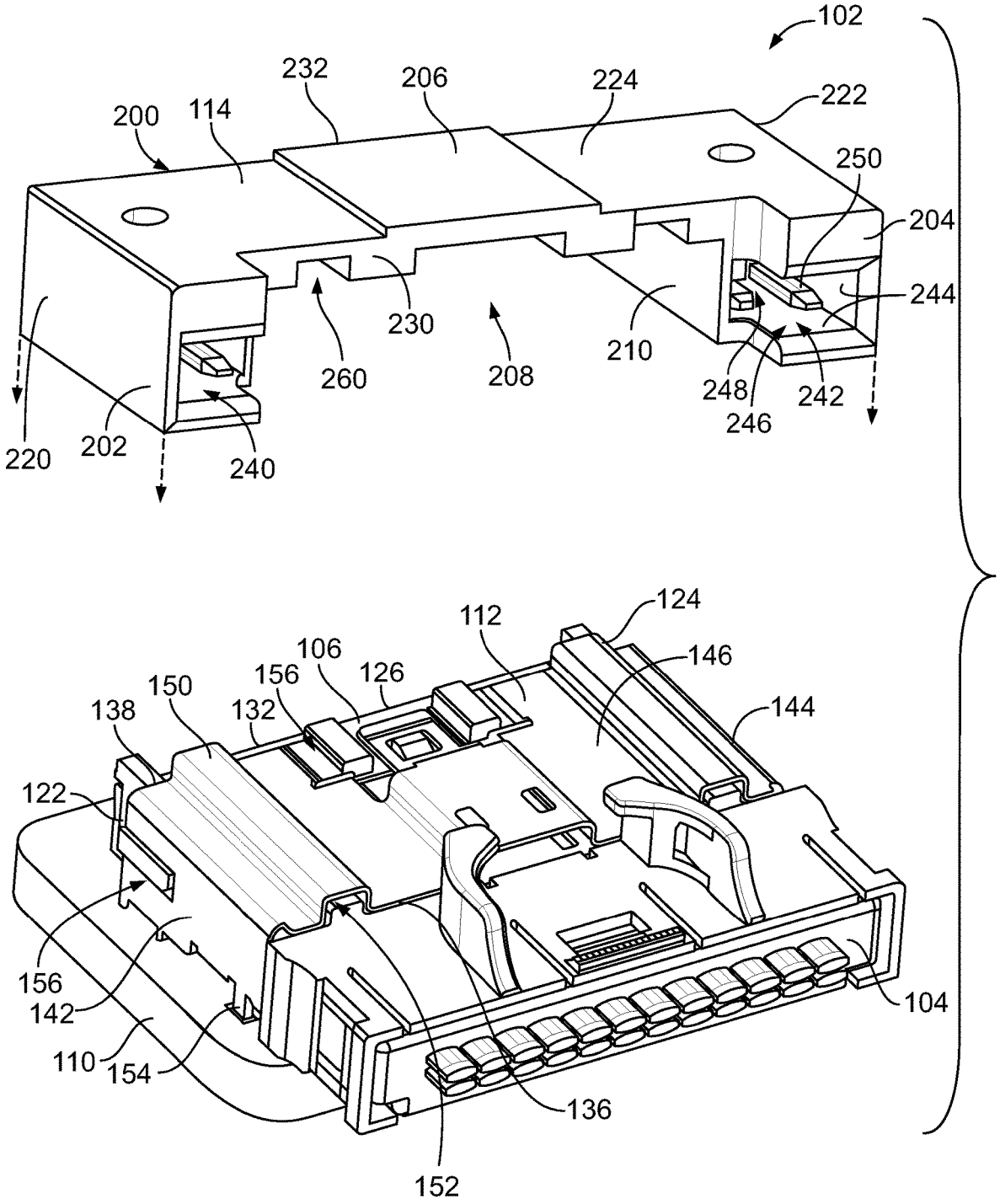
FIG. 3 is an exploded view of the card edge connector assembly in accordance with an exemplary embodiment.
Figure 4:
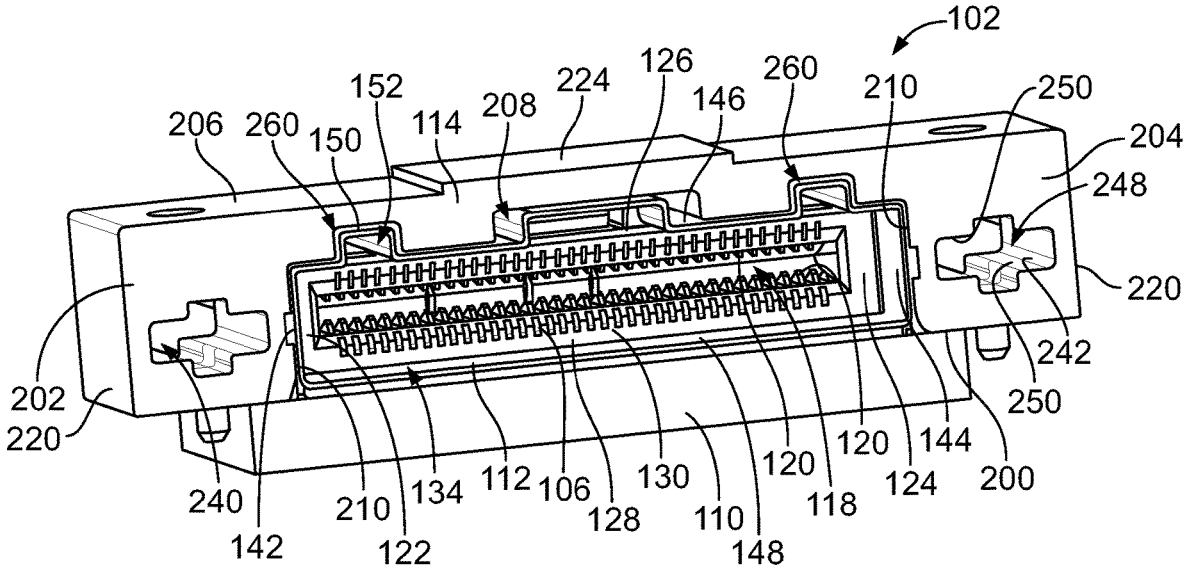
FIG. 4 is a cross-sectional view of the card edge connector assembly in accordance with an exemplary embodiment.

FIG. 1 is a perspective view of an electrical system 100 having a card edge connector assembly 102 in accordance with an exemplary embodiment showing a pluggable module 104 poised for mating with a card edge connector 106 (shown in FIGS. 2-4). The card edge connector 106 is mounted to a host circuit board 110. In the illustrated embodiment, the card edge connector 106 is a right angle card edge connector where the mating and mounting ends of the card edge connector 106 are oriented perpendicular such that the pluggable module 104 is mated parallel to the host circuit board 110. However, in other various embodiments, the electrical system 100 may have components in different orientations, such as in a vertical orientation where the components are mated in a vertical direction perpendicular to the host circuit board 110. Other types of card edge connectors may be utilized in alternative embodiments.

The card edge connector assembly 102 includes the card edge connector 106, a guide frame 112 and a guide cover 114 mounted over the card edge connector 106 and the guide frame 112. The card edge connector assembly 102 includes the pluggable module 104 mated with the card edge connector 106. The guide frame 112 is used to guide mating and unmating of the pluggable module 104 with the card edge connector 106. The guide cover 114 is used to guide mating and unmating of the pluggable module 104 with the guide frame 112 and the card edge connector 106. The guide cover 114 provides the initial alignment of the pluggable module 104, such as to square up the pluggable module 104 with the guide frame 112 and the card edge connector 106. The guide cover 114 may provide course alignment, while the guide frame 112 may provide fine alignment. In an exemplary embodiment, stress and strain from mating and use of the pluggable module 104 may be transferred to the host circuit board 110 through the guide cover 114. As such, the guide cover 114 may reduce stresses and strains on the card edge connector 106. For example, torsional loads on the pluggable module 104, such as from the cable of the pluggable module 104 may be transferred to the guide cover 114 rather than the card edge connector 106.

FIG. 2 is a front perspective view of the card edge connector assembly 102 showing the card edge connector 106 in accordance with an exemplary embodiment. FIG. 3 is an exploded view of the card edge connector assembly 102 in accordance with an exemplary embodiment. FIG. 4 is a cross-sectional view of the card edge connector assembly 102.

In an exemplary embodiment, the card edge connector 106 includes a housing 116 having a card slot 118. The housing 116 holds a plurality of contacts 120 in the card slot 118 for mating with the pluggable module 104. In an exemplary embodiment, the contacts 120 are arranged in two rows on opposite sides of the card slot 118 for electrically connecting to opposite sides of the pluggable module 104. The card edge connector 106 is configured to be mounted to the host circuit board 110, such as by soldering the contacts 120 of the card edge connector 106 to the host circuit board 110; however, the contacts 120 may be attached by other processes such as press fit contacts, spring beam contacts, and the like.

The housing 116 includes a first end wall 122 and a second end wall 124 opposite the first end wall 122. The housing 116 includes a first side wall 126 and a second side wall 128 opposite the first side wall 126. The side walls 126, 128 extend between the end walls 122, 124. In various embodiments, the housing 116 may be oriented such that the first side wall 126 is a top wall and the second side wall 128 is a bottom wall. The card slot 118 is defined between the side walls 126, 128. The contacts 120 are arranged along the first and second side walls 126, 128. In an exemplary embodiment, the housing 116 extends between a front 130 and a rear 132. The card slot 118 is open at the front 130 to receive the pluggable module 104. The front 130 defines a mating end of the card edge connector 106 to receive the pluggable module 104 in a mating direction, such as a mating direction parallel to the host circuit board 110. In the illustrated embodiment, the card edge connector 106 is oriented relative to the host circuit board 110 such that the second side wall 128 faces the host circuit board 110. The second side wall defines a mounting end of the card edge connector 106. Other orientations are possible in alternative embodiments, such as with the rear 132 defining the mounting end.

The guide frame 112 is used to guide mating of the pluggable module 104 with the card edge connector 106. In the illustrated embodiment, the guide frame 112 is separate and discrete from the housing 116. Alternatively, the guide frame 112 may be an integral part of the housing 116. For example, the guide frame 112 may be molded with the housing 116 as a unitary, monolithic structure. In an exemplary embodiment, the guide frame 112 is a stamped and formed structure sized and shaped to fit around the exterior of the housing 116. The guide frame 112 may be manufactured by other processes in alternative embodiments, such as being a molded piece.

The guide frame 112 includes walls defining a cavity 134 that receives the housing 116. The walls of the guide frame 112 extend between a front 136 and a rear 138. Optionally, the front 136 may be forward of the front 130 of the housing 116. For example, the guide frame 112 may be positioned forward of the housing 116 to interact with the pluggable module 104 prior to the pluggable module 104 interacting with the housing 116 and/or the contacts 120. As such, the guide frame 112 is used to orient the pluggable module 104 relative to the housing 116 and/or the contacts 120 prior to the pluggable module 104 engaging the housing 116 and/or the contacts 120. In an exemplary embodiment, the guide frame 112 includes lead-in surfaces 140 at the front 136 for gatherability and alignment during mating. The guide frame 112 may be used to position the pluggable module 104 side to side and/or end to end relative to the housing 116.

In an exemplary embodiment, the guide frame 112 includes a first end wall 142 and a second end wall 144 opposite the first end wall 142. The guide frame 112 includes a first side wall 146 extending between the first end wall 142 and the second end wall 144. The guide frame 112 may include a second side wall 148 opposite the first side wall 146. The second side wall 148 may be located forward of the housing 116 and/or may be located between the housing 116 and the host circuit board 110. In various embodiments, the guide frame 112 may be oriented such that the first side wall 146 is a top wall and the second side wall 148 is a bottom wall.

The first side wall 146 includes one or more guide features 150 configured to engage the pluggable module 104 to guide mating of the pluggable module 104 with the card edge connector 106. In other embodiments, the second side wall 148 may additionally or alternatively include the guide features 150. In the illustrated embodiment, each guide feature 150 includes a track 152. The side wall 146 may be stepped to define the tracks 152. The tracks 152 may be open to the cavity 134 to receive portions of the pluggable module 104. Other types of guide features 150 may be used in alternative embodiments, such as posts, rails, tabs, channels and the like.

In an exemplary embodiment, the guide frame 112 is directly mounted to the host circuit board 110. For example, the guide frame 112 includes mounting features 154 coupled to the host circuit board 110. In the illustrated embodiment, the mounting features 154 are pins extending from the first and second end walls 142, 144. The mounting features 154 may be compliant pins press-fit into the host circuit board 110. In other various embodiments, the mounting features 154 may be solder pins configured to be soldered to pads or vias of the host circuit board 110. Other types of mounting features may be used in alternative embodiments, such as clips, fasteners and the like. Separately mounting the guide frame 112 to the host circuit board 110, stresses and strains during mating or use of the pluggable module 104 may be transferred to the host circuit board 110 rather than being transferred to the housing 116, which may protect the contacts 120 from damage.

The guide frame 112 includes locating features 156 for locating the guide frame 112 relative to the housing 116. For example, the guide features may include slots, tabs, latches and the like that interact with complementary features of the housing 116 to position the guide frame 112 relative to the housing 116.

In various embodiments, the guide cover 114 includes a base 200 mounted to the host circuit board 110 independent of the card edge connector 106 and the guide frame 112 such that the guide cover 114 is self-supporting or otherwise not supported by the card edge connector 106. In an exemplary embodiment, the guide cover 114 includes support members for supporting the pluggable module 104, such as first and second support beams 202, 204 at opposite ends of the card edge connector 106. The guide cover 114 alleviates stress or strain on the card edge connector 106 from the pluggable module 104, such as from movement of the pluggable module 104. The support beams 202, 204 transfer stresses or strains from the pluggable module 104 into the base 200, and thus into the host circuit board 110, separate from the card edge connector 106, to alleviate stress or strain on the card edge connector 106.

The guide cover 114 includes a main body 206 between the support beams 202, 204. In an exemplary embodiment, the support beams 202, 204 each include one or more mounting features for mounting the guide cover 114 to the host circuit board 110. The mounting features may include openings and/or mounting hardware, such as fasteners. Other types of mounting features may be provided in alternative embodiments, such as a threaded opening, a post, a barb, a solder feature, and the like. In the illustrated embodiment, the main body 206 is located above the card edge connector 106, such that the main body 206 and the support beams 202, 204 surround the card edge connector 106. In the illustrated embodiment, the main body 206 connects the support beams 202, 204 such that the guide cover 114 is a single, unitary structure. The main body 206 includes a center cavity 208 that receives and/or surrounds the housing 116 and the guide frame 112. The center cavity 208 receives the pluggable module 104 during mating. The guide cover 114 guides mating of the pluggable module 104 with the card edge connector 106.

The support beams 202, 204 include inner ends 210 defining the center cavity 208. The inner ends 210 face the card edge connector 106 and/or the guide frame 112 and may engage the card edge connector 106 and/or the guide frame 112 to locate the guide cover 114 relative to the card edge connector 106. The inner ends 210 define locating surfaces for locating the guide cover 114 relative to the card edge connector 106 and/or the guide frame 112. The inner ends 210 may be vertical surfaces, angled surfaces and/or shoulder surfaces for engaging and locating various complementary surfaces of the card edge connector 106.

The main body 206 includes a plurality of walls. In the illustrated embodiment, the walls include a first end wall 220, a second end wall 222 opposite the first end wall 220, and a first side wall 224 extending between the end walls 220, 222. In other various embodiments, the main body 206 may include a second side wall (not shown) opposite the first side wall 224. The support beams 202, 204 are located at the first and second end walls 220, 222, respectively. In an exemplary embodiment, the first side wall 224 is wider than the first and second end walls 220, 222. The main body 206 includes a front 230 and a rear 232. Optionally, the support beams 202, 204 extend forward of the front 230 at the first side wall 224. In an exemplary embodiment, the center cavity 208 is open at the front 230, and may be open at the rear 232. The pluggable module 104 is configured to be loaded into the guide cover 114 through the front 230. The main body 206 may have other shapes in alternative embodiments, such as including additional walls.

In an exemplary embodiment, the guide cover 114 includes a first alignment channel 240 between the center cavity 208 and the first end wall 220 and a second alignment channel 242 between the center cavity 208 and the second end wall 222. The first alignment channel 240 is provided in the first support beam 202 and the second alignment channel 242 is provided in the second support beam 204. The alignment channels 240, 242 are configured to receive corresponding alignment posts of the pluggable module 104 to align the pluggable module 104 with the card edge connector 106. The alignment channels 240, 242 are open at the front 230 to receive the alignment posts of the pluggable module 104. The alignment channels 240, 242 are configured to receive the alignment posts of the pluggable module 104 prior to the card slot 118 receiving the pluggable module 104. The alignment channels 240, 242 provide the initial alignment of the pluggable module 104, such as to square up the pluggable module 104 with the guide frame 112 and the card edge connector 106.

The alignment channels 240, 242 are defined by alignment walls 244. The alignment walls 244 may engage and locate the pluggable module 104 relative to the guide cover 114. In an exemplary embodiment, the alignment channels 240, 242 include lead-in ports 246 at the front 230 to guide the pluggable module 104 into the alignment channels 240, 242. The alignment channels 240, 242 include locating tracks 248 at the rear 232 to locate the pluggable module 104 in the alignment channels 240, 242 to position the pluggable module 104 for mating with the guide frame 112 in the card edge connector 106. The locating tracks 248 have a different size and/or shape relative to the lead-in ports 246. The locating tracks 248 provide tighter or finer positioning than the lead-in ports 246. In the illustrated embodiment, the locating tracks 248 are defined by rails 250 extending into the alignment channels 240, 242. The rails 250 are configured to engage the pluggable module 104 to locate the pluggable module 104 relative to the guide cover 114. Other types of guide features may be provided in the alignment channels 240, 242 in alternative embodiments. The rails 250 may be chamfered to reduce binding and to guide the pluggable module 104 along the rails 250.

In an exemplary embodiment, the guide cover 114 includes pockets 260 in the first side wall 224 that receive portions of the guide frame 112. The pockets 260 may receive the guide tracks 152 of the guide frame 112. The interior surface of the first side wall 224 facing the center cavity 208 may have a complementary shape to the exterior surface of the first side wall 146 of the guide frame 112. The interior surface of the first side wall 224 may engage the exterior surface of the first side wall 146.

Figure 5:
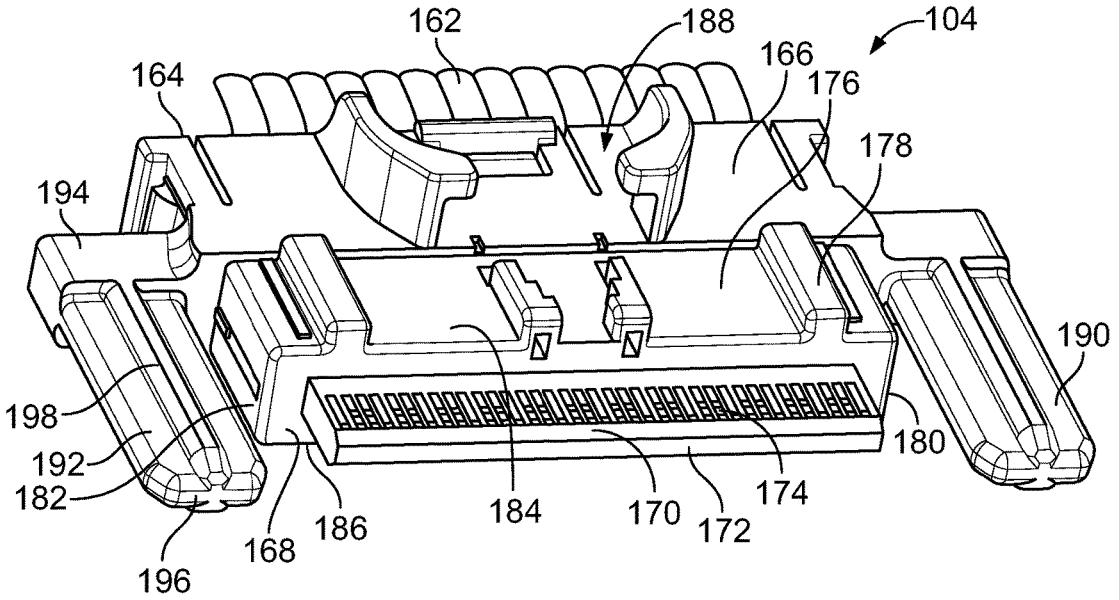
FIG. 5 is a perspective view of a pluggable module of the card edge connector assembly in accordance with an exemplary embodiment.

FIG. 5 is a perspective view of the pluggable module 104 in accordance with an exemplary embodiment. In the illustrated embodiment, the pluggable module is a cabled pluggable module having one or more cables 162 extending from a cable end or rear 164 of the pluggable module 104; however, other types of pluggable modules may be utilized in alternative embodiments, such as non-cabled pluggable modules. The pluggable module 104 includes a plug body 166 holding a plug card 170, such as a circuit card, at a mating end or front 168 of the pluggable module 104. The plug card 170 may extend forward of the plug body 166 a distance for loading into the card edge connector 106 (shown in FIG. 2). The cables 162 are terminated to the plug card 170, such as by soldering to the plug card 170. Optionally, the plug body 166 may be overmolded over the plug card 170 and the cables 162.

The plug card 170 has a card edge 172 at the mating end 168 configured to be loaded into the card edge connector 106. The pluggable module 104 has a plurality of plug contacts 174 at the card edge 172 configured to be electrically connected to the card edge connector 106. The plug contacts 174 may be pads or traces on the circuit card defining the plug card 170. Other types of plug contacts 174 may be used in alternative embodiments. Optionally, the pluggable module 104 may include one or more electrical components (not shown) on the plug card 170, such as a memory, a processor, or other types of electrical components. The electrical components are electrically connected to corresponding plug contacts 174. The pluggable module 104 includes various circuits transmitting data and/or power between the plug contacts 174, the electrical components, and the cables 162. The pluggable module 104 may include one or more heat sinks for dissipating heat from the pluggable module 104.

In an exemplary embodiment, the pluggable module 104 includes a hub 176 forming the bulk of the plug body 166. The hub 176 surrounds the plug card 170. In an exemplary embodiment, the hub 176 includes one or more guide ribs 178 used to guide mating with the guide frame 112. For example, the guide ribs 178 may extend parallel to the mating direction and are configured to be received in the tracks 152 of the guide frame 112. Other types of guide features may be provided on the hub 176 in alternative embodiments.

The hub 176 extends between a first end 180 and a second end 182. The pluggable module 104 has a first side 184 and a second side 186 (shown in FIG. 1) between the first and second ends 180, 182. The sides 184, 186 are wider than the ends 180, 182. In the illustrated embodiment, the guide ribs 178 extend along the first side 184. The pluggable module 104 includes latching features 188 at the first side 184 and/or the second side 186 for securing the pluggable module 104 in the card edge connector assembly 102.

The pluggable module 104 includes a first alignment post 190 outboard of the first end 180 of the hub 176 and a second alignment post 192 outboard of the second end 182 of the hub 176. The first and second alignment posts 190, 192 flank the opposite ends 180, 182 of the hub 176. Each alignment post 190, 192 extends between a base 194 and a distal end 196. The base 194 extends from the hub 176. In an exemplary embodiment, the distal ends 196 are forward of the front of the hub 176. As such, the alignment posts 190, 192 are configured to engage the guide cover 114 prior to the hub 176 engaging the guide cover 114. In an exemplary embodiment, the distal ends 196 are forward of the card edge 172 of the plug card 170. As such, the alignment posts 190, 192 are configured to engage the guide cover 114 prior to the plug card 170 engaging the guide cover 114.

The alignment posts 190, 192 may have an appropriate shape for loading into the alignment channels 240, 242 of the guide cover 114. In the illustrated embodiment, the alignment posts 190, 192 are cross-shaped; however, the alignment posts 190, 192 may have other shapes in alternative embodiments. For example, the alignment posts 190, 192 may be rectangular, circular or have other shapes. In an exemplary embodiment, each alignment post 190, 192 includes ribs 198 that are used to orient the alignment posts 190, 192 within the alignment channels 240, 242 of the guide cover 114. The ribs 198 form the cross shaped alignment posts 190, 192.

Figure 6:
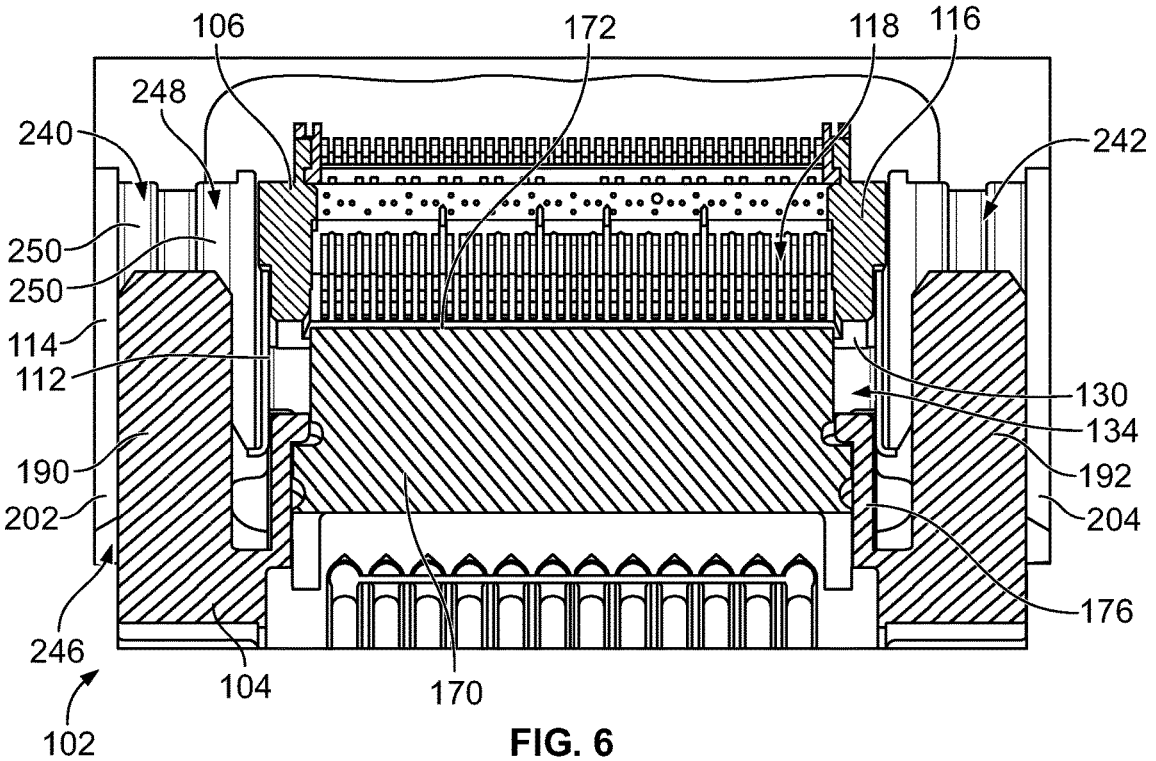
FIG. 6 is a cross sectional view of the card edge connector assembly in accordance with an exemplary embodiment.

FIG. 6 is a cross sectional view of the card edge connector assembly 102 in accordance with an exemplary embodiment showing the pluggable module 104 partially loaded into the guide cover 114 in accordance with an exemplary embodiment. During mating and unmating, the guide cover 114 is used to orient the pluggable module 104 relative to the card edge connector 106 and guide mating in the mating direction and unmating in the opposite direction.

The alignment posts 190, 192 are received in the alignment channels 240, 242 to guide mating and unmating. The alignment posts 190, 192 center of the hub 176 relative to the guide frame 112. As such, the hub 176 may be received in the cavity 134 of the guide frame 112. The alignment posts 190, 192 are received in the alignment channels 240, 242 prior to the plug card 170 being received in the card slot 118. The alignment posts 190, 192 and the alignment channels 240, 242 cooperate to center the plug card 170 relative to the card slot 118. The alignment posts 190, 192 and the alignment channels 240, 242 cooperate to square up the card edge 172 relative to the housing 116 to ensure that the card edge 172 is parallel to the front 130 of the housing 116. The alignment posts 190, 192 and the alignment channels 240, 242 ensure that the plug card 170 is loaded straight into the card slot 118 rather than be loaded at an angle and twisting or rotating the plug card 170 into the housing 116.

In an exemplary embodiment, the alignment posts 190, 192 extend forward of the card edge 172 of the plug card 170 such that the alignment posts 190, 192 are loaded into the guide cover 114 prior to the plug card 170 being loaded into the guide cover 114. In an exemplary embodiment, the support beams 202, 204 extend forward of the housing 116 to interact with the alignment posts 190, 192 prior to loading the pluggable module 104 into the guide frame 112 and/or the housing 116. The alignment posts 190, 192 are outboard of the plug card 170 so as to not interfere with mating of the plug card 170 with the housing 116. The alignment channels 240, 242 are outboard of the housing 116 so as to not interfere with mating of the plug card 170 with the housing 116. The lead-in ports 246 are located forward of the locating tracks 248 to guide the alignment posts 190, 192 into the locating tracks 248. The ribs 198 (shown in FIG. 4) of the alignment posts 190, 192 are received in the locating tracks 248. For example, the ribs 198 may be received between the rails 250. The ribs 198 engage the rails 250 to resist torsion loads or rotation of the pluggable module 104 relative to the guide cover 114, such as when pulling on the cable of the pluggable module 104. The outer edges of the alignment posts 190, 192 may engage the interior walls of the alignment channels 240, 242 to resist torsion loads or rotation of the pluggable module 104 relative to the guide cover 114. The alignment post 190, 192 are long alignment features to resist torsion loads or rotation of the pluggable module 104 relative to the guide cover 114.

Figure 7:
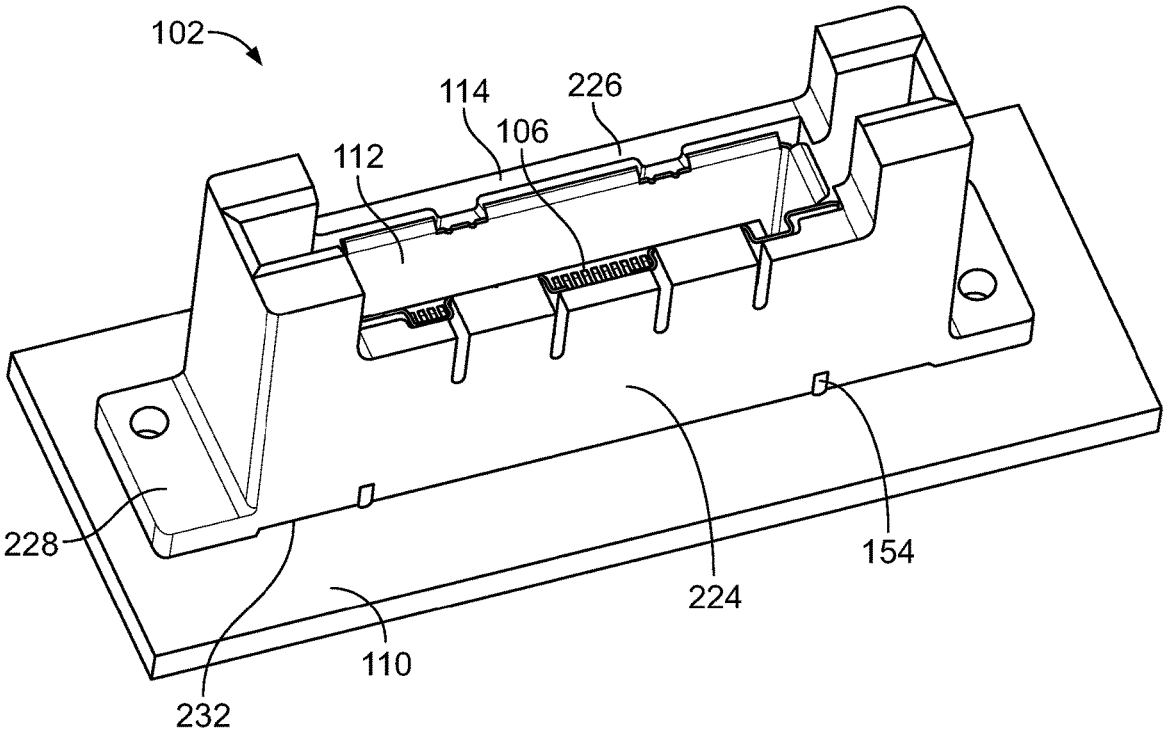
FIG. 7 is a perspective view of the card edge connector assembly in accordance with an exemplary embodiment.

FIG. 7 is a perspective view of the card edge connector assembly 102 in accordance with an exemplary embodiment. In the illustrated embodiment, the card edge connector assembly 102 has a vertical orientation rather than the right-angle orientation shown in FIG. 1 and like components are identified with like reference numerals. The card edge connector 106 is oriented vertically such that the pluggable module 104 is configured to be mated in a downward direction, perpendicular to the host circuit board 110.

The guide frame 112 and the guide cover 114 are slightly modified for mounting to the host circuit board 110 in the vertical orientation relative to the card edge connector 106. For example, the mounting features 154 of the guide frame 112 may have a different location and/or orientation. In the illustrated embodiment, the guide cover 114 includes a second side wall 226 opposite the first side wall 224. The guide cover 114 includes mounting features 228, such as flanges, at the rear 232 for mounting to the host circuit board 110.

Figure 8:
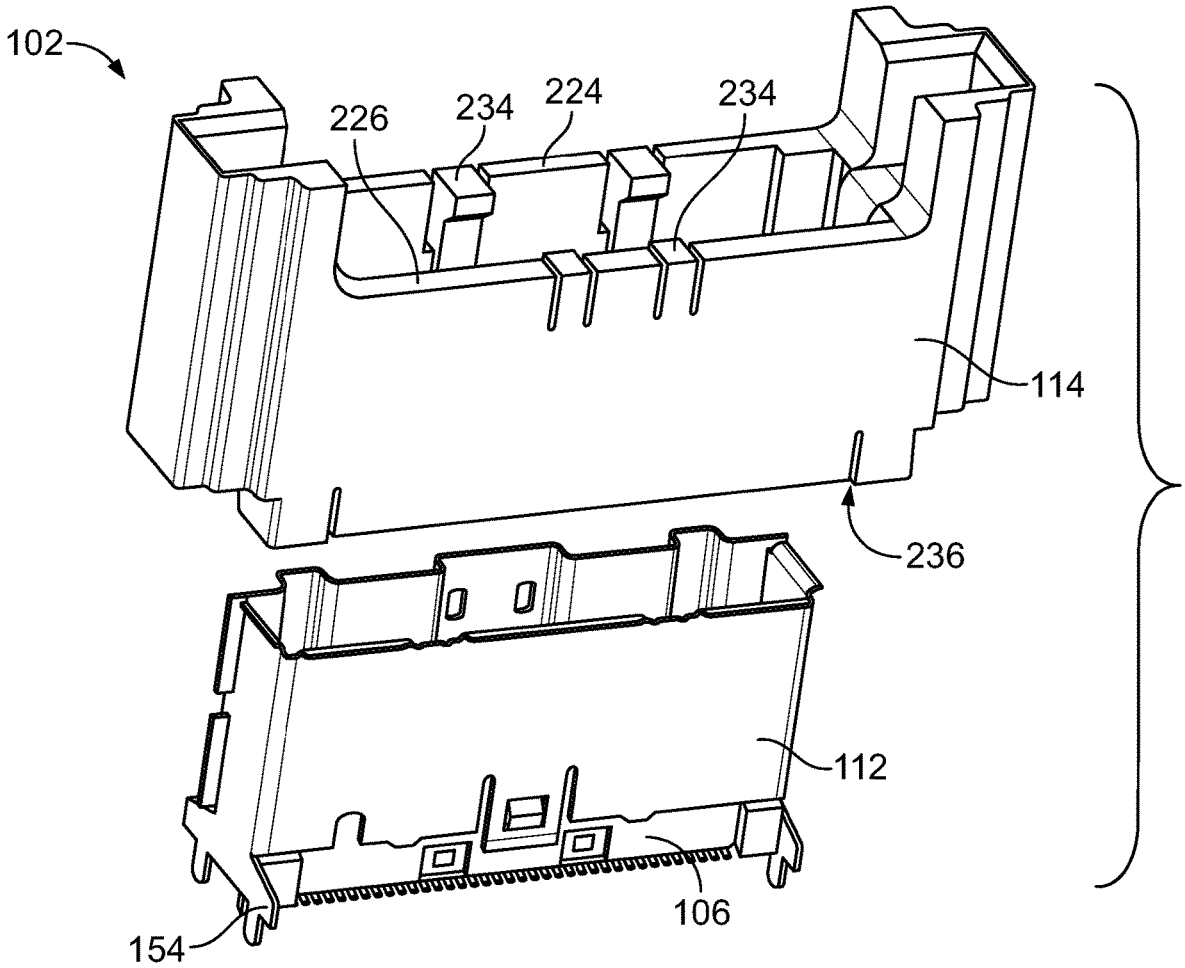
FIG. 8 is an exploded view of the card edge connector assembly in accordance with an exemplary embodiment.
Figure 9:
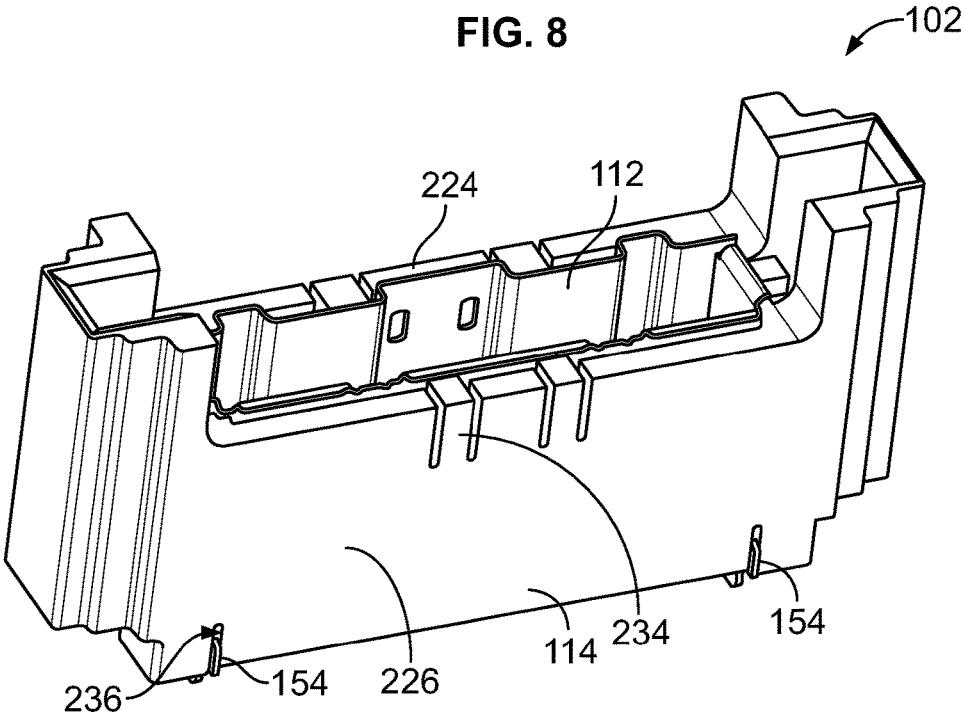
FIG. 9 is a front perspective view of the card edge connector assembly in accordance with an exemplary embodiment.

FIG. 8 is an exploded view of the card edge connector assembly 102 in accordance with an exemplary embodiment. FIG. 9 is a front perspective view of the card edge connector assembly 102 in accordance with an exemplary embodiment. In the illustrated embodiment, the card edge connector assembly 102 has a vertical orientation similar to the embodiment illustrated in FIG. 7. The guide cover 114 illustrated in FIGS. 8 and 9 may be retrofit for installation onto the guide frame 112 and the card edge connector 106, rather than being separately mounted to the host circuit board 110 has with the embodiment illustrated in FIG. 7. In the illustrated embodiment, the first and second side walls 224, 226 include latches 234 configured to latch be coupled to the guide cover 114 directly to the guide frame 112. The mounting features 154 of the guide frame 112 are received in slots 236 in the guide cover 114 to position the guide cover 114 relative to the guide frame 112 and the card edge connector 106.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector assembly comprising:

a card edge connector mounted to a host circuit board, the card edge connector having a dielectric housing defining a card slot configured to receive a pluggable module in a mating direction, the housing holding contacts in the card slot to electrically connect to the pluggable module, the contacts being configured to be electrically connected to the host circuit board; and a guide cover separate and discrete from the card edge connector, the guide cover being separately mounted to the host circuit board, the guide cover having a main body including a first end wall, a second end wall opposite the first end wall, and a first side wall between the first and second end walls, the main body defining a center cavity, the center cavity receiving the housing of the card edge connector, the center cavity configured to receive the pluggable module, the guide cover having a first alignment channel between the center cavity and the first end wall, the guide cover having a second alignment channel between the center cavity and the second end wall;

wherein the first and second alignment channels are configured to receive alignment posts of the pluggable module prior to the card slot receiving the pluggable module.

2. The card edge connector assembly of claim 1, wherein the guide cover includes a first protrusion at the first end wall extending forward of a front of the first side wall and a second protrusion at the second end wall extending forward of the front of the first side wall, the first and second alignment channels extending through the first and second protrusions, respectively.

3. The card edge connector assembly of claim 1, wherein the guide cover extends forward of the housing to receive the pluggable module prior to the housing receiving the pluggable module.

4. The card edge connector assembly of claim 1, wherein the guide cover is mounted to the host circuit board separate from the housing to transfer loads to the host circuit board independent of the housing.

5. The card edge connector assembly of claim 1, wherein the housing has a housing width between a front and a rear of the housing, the guide cover having a guide cover width between a front and a rear of the guide cover, the guide cover width being wider than the housing width.

6. The card edge connector assembly of claim 1, wherein the guide cover includes a second side wall opposite the first side wall extending between the first and second end walls, the center cavity defined between the first and second side walls.

7. The card edge connector assembly of claim 1, wherein the center cavity is open at a second side opposite the first side wall.

8. The card edge connector assembly of claim 1, wherein the card edge connector further comprises a guide frame coupled to the housing, the guide frame extending forward of the housing, the guide frame having a guide track extending parallel to the mating direction, the guide track being configured to receive a guide rib of the pluggable module to guide mating of the pluggable module into the card slot.

9. The card edge connector assembly of claim 8, wherein the first side wall includes a pocket along an interior surface of the first side wall receiving the guide track.

10. The card edge connector assembly of claim 1, further comprising a pluggable module mated with the card edge connector, the pluggable module having a plug card having plug contacts arranged at a card edge of the plug card, the pluggable module having a plug body having a hub holding the plug card, the plug body having a first alignment post outboard of a first end of the hub and a second alignment post outboard of a second end of the hub, the first and second alignment posts extending forward of the hub.

11. The card edge connector assembly of claim 10, wherein the hub includes a first end wall, a second end wall, a first side wall and a second side wall, the first and second alignment posts being outboard of the first and second end walls of the hub.

12. The card edge connector assembly of claim 1, wherein the first and second alignment channels are separated from the housing by the main body.

13. The card edge connector assembly of claim 1, wherein the first and second alignment channels are cross-shaped.

14. A card edge connector assembly comprising:

a card edge connector mounted to a host circuit board, the card edge connector having a housing defining a card slot configured to receive a pluggable module in a mating direction, the housing holding contacts in the card slot to electrically connect to the pluggable module, the contacts being configured to be electrically connected to a host circuit board;

a guide frame coupled to the housing, the guide frame extending forward of the housing, the guide frame having a guide track extending parallel to the mating direction, the guide track configured to receive a guide rib of the pluggable module to guide mating of the pluggable module into the card slot; and a guide cover separate and discrete from the card edge connector, the guide cover being separately mounted to the host circuit board, the guide cover having a main body including a first end wall, a second end wall opposite the first end wall, and a first side wall between the first and second end walls, the main body defining a center cavity, the center cavity receiving the housing of the card edge connector and the guide frame, the center cavity configured to receive the pluggable module, the guide cover having a first alignment channel between the center cavity and the first end wall, the guide cover having a second alignment channel between the center cavity and the second end wall;

wherein the first and second alignment channels are configured to receive alignment posts of the pluggable module prior to the guide track of the guide frame receiving the guide rib.

15. The card edge connector assembly of claim 14, wherein the guide cover extends forward of the housing to receive the pluggable module prior to the housing receiving the pluggable module.

16. The card edge connector assembly of claim 14, further comprising a pluggable module mated with the card edge connector, the pluggable module having a plug card having plug contacts arranged at a card edge of the plug card, the pluggable module having a plug body having a hub holding the plug card, the plug body having a first alignment post outboard of a first end of the hub and a second alignment post outboard of a second end of the hub, the first and second alignment posts extending forward of the hub.

17. A card edge connector assembly comprising:

a card edge connector having a dielectric housing mounted to a host circuit board and the card edge connector having a guide cover separate and discrete from the housing being separately mounted to the host circuit board, the guide cover at least partially surrounding the housing, the housing defining a card slot and holding contacts in the card slot, the contacts being configured to be electrically connected to a host circuit board, the guide cover having a main body including a first end wall, a second end wall opposite the first end wall, and a first side wall between the first and second end walls, the main body defining a center cavity receiving the housing of the card edge connector, the guide cover having a first alignment channel between the center cavity and the first end wall, the guide cover having a second alignment channel between the center cavity and the second end wall; and a pluggable module mated with the card edge connector, the pluggable module having a plug card having plug contacts arranged at a card edge of the plug card, the pluggable module having a plug body including a hub holding the plug card, the plug body having a first alignment post outboard of a first end of the hub and a second alignment post outboard of a second end of the hub, the first and second alignment posts extending forward of the hub;

wherein the first and second alignment channels receive the first and second alignment posts, respectively, prior to the card slot receiving the card edge of the circuit card of the pluggable module.

18. The card edge connector assembly of claim 17, wherein the guide cover extends forward of the housing to receive the pluggable module prior to the housing receiving the pluggable module.

19. The card edge connector assembly of claim 17, wherein the card edge connector further comprises a guide frame coupled to the housing, the guide frame extending forward of the housing, the guide frame having a guide track extending parallel to the mating direction, the guide track being configured to receive a guide rib of the pluggable module to guide mating of the pluggable module into the card slot.

20. The card edge connector assembly of claim 17, wherein the hub includes a first end wall, a second end wall, a first side wall and a second side wall, the first and second alignment posts being outboard of the first and second end walls of the hub.

* * * * *